US009903653B2

(12) United States Patent
Mizutani et al.

(10) Patent No.: US 9,903,653 B2
(45) Date of Patent: Feb. 27, 2018

(54) MELTING FURNACE

(71) Applicant: DAIDO STEEL CO., LTD., Nagoya-shi, Aichi (JP)

(72) Inventors: Kota Mizutani, Aichi (JP); Masato Ogawa, Aichi (JP); Kunio Matsuo, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 0 days.

(21) Appl. No.: 14/930,809

(22) Filed: Nov. 3, 2015

(65) Prior Publication Data

US 2016/0123666 A1 May 5, 2016

(30) Foreign Application Priority Data

Nov. 5, 2014 (JP) ..... 2014-225147
Jul. 24, 2015 (JP) ..... 2015-146742

(51) Int. Cl.
*F27D 1/00* (2006.01)
*H05B 7/11* (2006.01)
(Continued)

(52) U.S. Cl.
CPC ..... *F27B 3/085* (2013.01); *F27B 3/12* (2013.01); *F27B 3/183* (2013.01); *F27D 3/0025* (2013.01);
(Continued)

(58) Field of Classification Search
CPC .. F27B 3/085; F27B 3/183; F27B 3/12; F27B 2014/0831; F27D 11/08; F27D 3/0025; F27D 2003/0087
(Continued)

(56) References Cited

U.S. PATENT DOCUMENTS 1,378,972 A * 5/1921 Moore ..... F27D 11/08 313/147
2,686,961 A * 8/1954 Ellefsen ..... F27B 3/06 373/72
(Continued)

FOREIGN PATENT DOCUMENTS

JP S60-122886 7/1985
JP 2014/40965 3/2014
JP 2015/48976 3/2015

OTHER PUBLICATIONS

U.S. Appl. No. 14/930,775 to Noriyuki Tomita et al., filed Nov. 3, 2015.
(Continued)

*Primary Examiner* — Hung D Nguyen
(74) *Attorney, Agent, or Firm* — Greenblum & Bernstein, P.L.C.

(57) ABSTRACT

A melting furnace is provided, that may contain a furnace shell, a furnace shell moving mechanism that supports the furnace shell so as to be movable on an installation surface, a pipe or a wiring that has one end fixed to the furnace shell and has at least partially, a flexible portion, and a stand. The stand may contain a supporting part that supports a halfway portion of the pipe or the wiring, and a stand moving part that is coupled to the supporting part and moves the supporting part on an installation surface in synchronization with movement of the furnace shell, in which the stand is mounted on the installation surface so as to be movable up and down with respect to the furnace shell.

11 Claims, 7 Drawing Sheets

(51) Int. Cl.

| | |
|---|---|
| ***F27B 3/08*** | (2006.01) |
| ***F27B 3/12*** | (2006.01) |
| ***F27B 3/18*** | (2006.01) |
| ***F27D 11/08*** | (2006.01) |
| *F27D 3/00* | (2006.01) |
| *F27B 14/08* | (2006.01) |

(52) U.S. Cl.
CPC ..... *F27D 11/08* (2013.01); *F27B 2014/0831* (2013.01); *F27D 2003/0087* (2013.01)

(58) Field of Classification Search
USPC ..... 373/60, 69, 71, 72, 75, 76, 79, 81, 84, 373/102, 103
See application file for complete search history.

(56) References Cited

U.S. PATENT DOCUMENTS

| | | | | |
|---|---|---|---|---|
| 2,907,807 | A | 10/1959 | Noesen | |
| 3,237,930 | A | 3/1966 | Hofmann | |
| 3,955,964 | A | 5/1976 | MacDonald et al. | |
| 3,980,801 | A * | 9/1976 | Milasius | F27D 3/18 373/84 |
| 4,110,546 | A | 8/1978 | Stenkvist | |
| 4,638,487 | A | 1/1987 | Tomizawa | |
| 4,662,526 | A | 5/1987 | Schaller | |
| 4,679,773 | A | 7/1987 | Wunsche | |
| 4,694,465 | A | 9/1987 | Nanjo et al. | |
| 5,153,894 | A * | 10/1992 | Ehle | C21O 5/5211 373/100 |
| 5,264,020 | A | 11/1993 | Ehle et al. | |
| 5,756,957 | A * | 5/1998 | Titus | A62D 3/19 110/250 |
| 6,274,081 | B1 | 8/2001 | Fuchs | |
| 6,377,605 | B1 | 4/2002 | McCaffrey | |
| 2002/0110175 | A1 * | 8/2002 | Stercho | C21O 5/5294 373/79 |

OTHER PUBLICATIONS

U.S. Appl. No. 14/930,823 to Kota Mizutani et al., filed Nov. 3, 2015.
U.S. Appl. No. 14/930,793 to Noriyuki Tomita et al., filed Nov. 3, 2015.
Official Action issued in U.S. Appl. No. 14/930,793 dated Nov. 16, 2017.
Office Action issued in related U.S. Appl. No. 14/930,823, dated Dec. 21, 2017.
Office Action issued in related U.S. Appl. No. 14/930,775, dated Dec. 18, 2017.

* cited by examiner

MELTING FURNACE

FIELD OF THE INVENTION

The present invention relates to a melting furnace and, in particular, relates to a melting furnace in which metal is melted while moving a furnace shell.

BACKGROUND ART OF THE INVENTION

In an arc furnace as a kind of melting furnace for melting metal material, a so-called hot spot and cold spot are formed within an inner space of a furnace shell containing the metal material. The hot spot places close to electrodes and at which the metal material is likely to be melted. The cold spot places distant from the electrodes and at which the metal material is not likely to be melted. In the cold spot, there arise a problem that it takes a long period of time to melt the metal material and thus melting of the metal material proceeds uniformly as a whole. In order to solve this problem, Patent Literature 1 proposes a process in which a furnace shell is rotationally displaced around an axis line extending in an up-down direction with respect to electrodes, thereby exchanging between the cold spot and the hot spot. In such the electric arc furnace, thermal nonuniformity within the furnace can be eliminated and an amount of wasteful power consumption can be reduced by rotationally displacing the furnace shell, without consuming power for a pump at an extra water-cooled part like in a shaft furnace and without additionally supplying burner combustion energy or the like for a composition appropriating processing of exhaust gas. Patent Literature 2 discloses a concrete configuration of an arc furnace which can perform such a rotational displacement of a furnace shell and tilting of the furnace shell for pouring.

Patent Literature 1: JP-A-2014-40965

Patent Literature 2: JP-A-2015-48976

SUMMARY OF THE INVENTION

To a furnace shell of an arc furnace are attached many auxiliary facilities such as a water-cooled panel and a burner, and cooling water, air, gas and so on used in these facilities are supplied via pipes. Each of these pipes is in a state that one end thereof is fixed to the furnace shell. In a case of rotationally displacing entirety of the furnace shell in this state as disclosed in Patent Literatures 1 and 2, it is necessary to use the pipes each of which is formed by flexible material like a flexible hose or the like and has a sufficient length capable of following an entire rotating area of the furnace shell. However, a load is likely to be applied to respective portions of each of the pipes due to own weight of the each pipe and also due to deformation or the like of a halfway portion of the each pipe accompanied by the rotation of the furnace shell. As a result, each of the pipes itself or coupling members coupled to both ends of the each pipe may be damaged, and this damage may cause leakage of fluid flowing within the pipes. Further, a similar problem is assumed to occur also in electric wirings for supplying power for driving the auxiliary facilities provided at the furnace shell and in electric wirings for transmitting signals for controlling the auxiliary facilities.

Therefore, an object of the present invention is to provide a melting furnace which has a furnace shell being moved and can protect pipes and wirings attached to the furnace shell from damage accompanied by movement of the furnace shell.

In order to solve the above-mentioned problem, the present invention provides a melting furnace, containing:

a furnace shell;

a furnace shell moving mechanism that supports the furnace shell so as to be movable on an installation surface;

a pipe or a wiring that has one end fixed to the furnace shell and has at least partially a flexible portion; and a stand that containing a supporting part that supports a halfway portion of the pipe or the wiring, and a stand moving part that is coupled to the supporting part and moves the supporting part on the installation surface with movement of the furnace shell, in which the stand is mounted on the installation surface so as to be movable in an up-down direction with respect to the furnace shell.

Here, it is preferable that the stand moving part contains a wheel that moves on the installation surface, and the supporting part is coupled to the furnace shell so as to be movable up and down by a coupling unit that transmits movement of the furnace shell induced by the furnace shell moving mechanism to the wheel. In this case, the coupling unit preferably has a pin structure that couples the stand to the furnace shell so as to make the stand rotatable within a plane containing the up-down direction. Further, the melting furnace preferably further contains a track installed in order to guide the movement of the wheel.

The stand moving part is preferably provided at halfway portion of the supporting part.

The melting furnace preferably further contains an insulation installed in at least one of a portion between the supporting part and the furnace shell, a portion between the supporting part and the stand moving part, and a portion between the furnace shell and the furnace shell moving mechanism. In this case, the furnace shell, the furnace shell moving mechanism and the supporting part are preferably independently grounded.

The installation surface is preferably tiltable in a state of supporting the furnace shell and the stand.

The melting furnace preferably further contains a lock mechanism in at least one of the furnace shell moving mechanism and the stand, which the lock mechanism inhibits movement of the furnace shell and the stand on the installation surface.

In the melting furnace according to the present invention, a pipe or wiring is supported at its halfway portion by a stand and the stand moves in synchronous with the movement of a furnace shell. Thus, when the furnace shell moves, the pipe or wiring moves together with the furnace shell in a state where its halfway portion is supported by the stand. As a result, a load of its own weight of the pipe or wiring and a load accompanied by the movement of the furnace shell are unlikely to be applied to the pipe or wiring. Thus, the pipe or wiring is prevented from being damaged by these loads. Further, since the stand is movable up and down with respect to the furnace shell, even if there is an irregularity on a locus along which the stand moves on the installation surface, up/down vibration of the stand at the time when the stand moves in synchronous with the movement of the furnace shell is suppressed. Thus, the pipe or wiring is suppressed from being damaged by the up/down vibration of the stand accompanied by the movement of the stand.

Here, in the case where the stand moving part contains a wheel that moves on the installation surface and the supporting part is coupled to the furnace shell so as to be movable up and down by a coupling unit that transmits movement of the furnace shell induced by the furnace shell moving mechanism to the wheel, the stand can be made to move in synchronism with the movement of the furnace shell with a simple configuration.

In the case where the coupling unit has a pin structure that couples the stand to the furnace shell so as to make the stand rotatable within a plane containing the up-down direction, the stand can be coupled to the furnace shell in a state of being movable up and down, with a simple configuration.

In the case where the installation surface is provided with a track for guiding movement of the wheel, the stand can be moved smoothly in synchronism with the movement of the furnace shell.

In the case where the stand moving part is provided at a halfway portion of the supporting part, the pipe or wiring can be stably supported by the stand and hence highly protected from application of a load.

In the case where the melting furnace further contains: an electrode provided in the furnace shell; and an insulation member provided in at least one of a portion between the supporting part and the furnace shell, a portion between the supporting part and the stand moving part, and a portion between the furnace shell and the furnace shell moving mechanism, the following effect can be provided. That is, even when current flows in the furnace shell due to current flowing in the electrodes, this current flowing in the furnace shell is prevented from negatively affecting the supporting part of the stand, the stand moving part and the furnace shell moving mechanism by flowing in respective portions.

In the case where the furnace shell, the furnace shell moving mechanism and the supporting part are independently grounded, such a phenomenon can be highly prevented from occurring that, when current flows in the furnace shell, this current flows in the above-mentioned respective portions and negatively affects thereon.

In the case where the installation surface is tiltable in a state of supporting the furnace shell and the stand, at a time of tilting the installation surface, even if a large rotation torque is applied to the furnace shell from the pipe or wiring which one end is fixed, since the pipe or wiring is supported by the stand that tilts together with the furnace shell, the rotation torque applied to the furnace shell can be reduced.

In the case where on at least one of the furnace shell moving mechanism and the stand is provided a lock mechanism which inhibits movement of the furnace shell and the stand on the installation surface, the furnace shell can be stably held on the installation surface while the furnace shell is not moved. In particular, in the case where the installation surface is tiltable in a state of supporting the furnace shell and the stand, a tilting operation can be performed stably by placing the furnace shell in a movement-inhibited state by the lock mechanism.

BRIEF DESCRIPTION OF THE DRAWINGS

FIG. 6A is a side view; and FIG. 6B is a sectional view along a direction connecting a tapping hole and a slag door.

DETAILED DESCRIPTION OF THE INVENTION

Explanation will be made with reference to the drawings as to an electric arc furnace as an example of a blast furnace according to an embodiment of the present invention.

(Configuration of Electric Arc Furnace)

Figure 1:
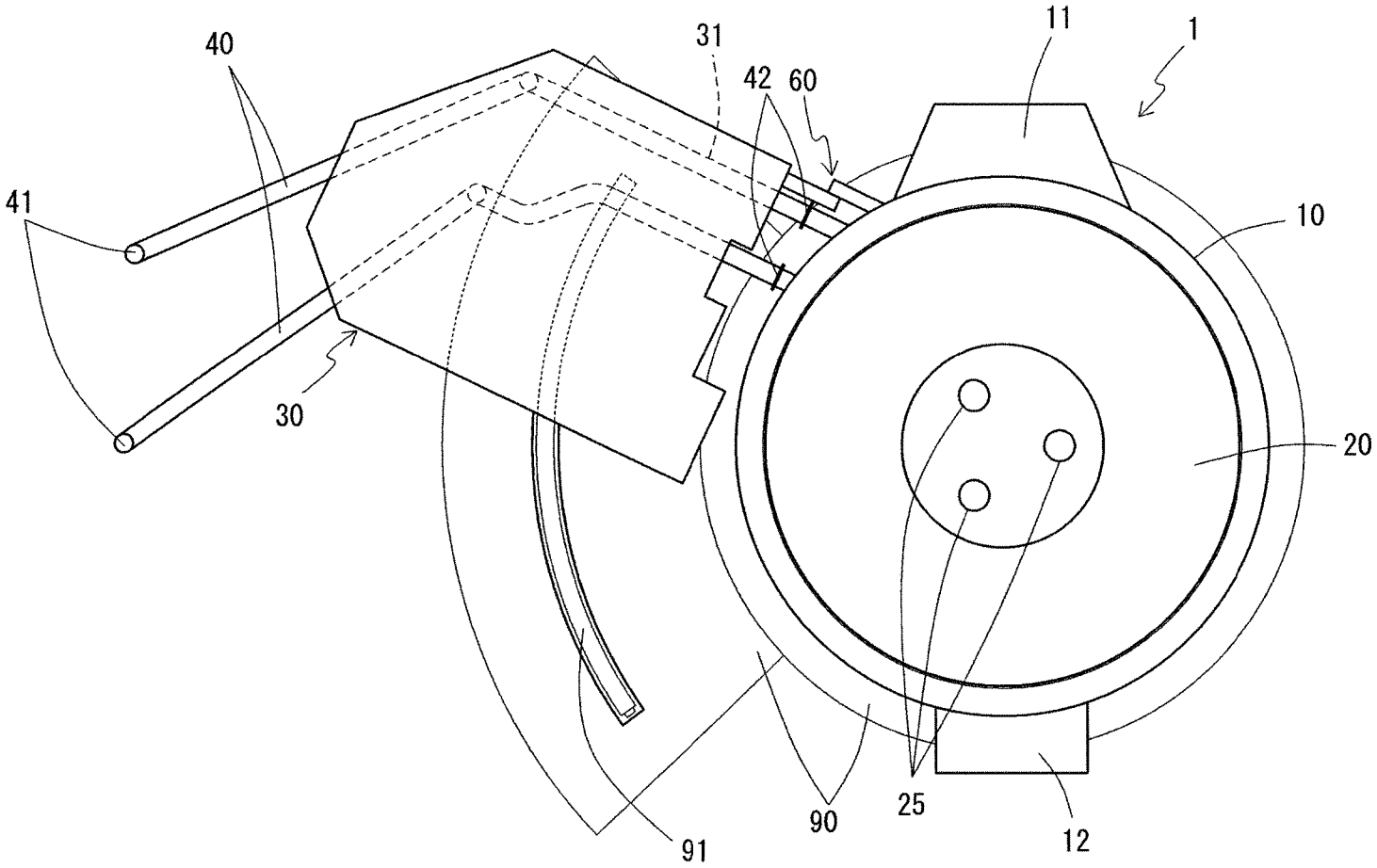
FIG. 1 is a top view illustrating an electric arc furnace according to an embodiment of the present invention.
Figure 2:
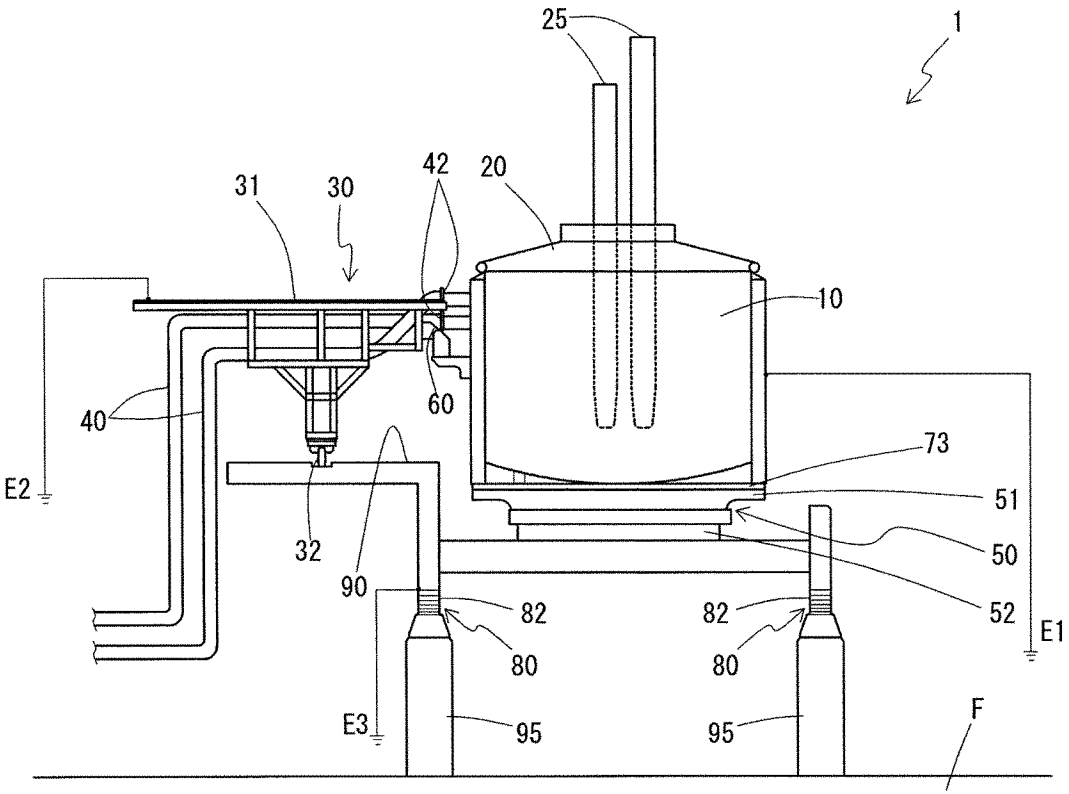
FIG. 2 is a side view illustrating the electric arc furnace of FIG. 1.
Figure 3:
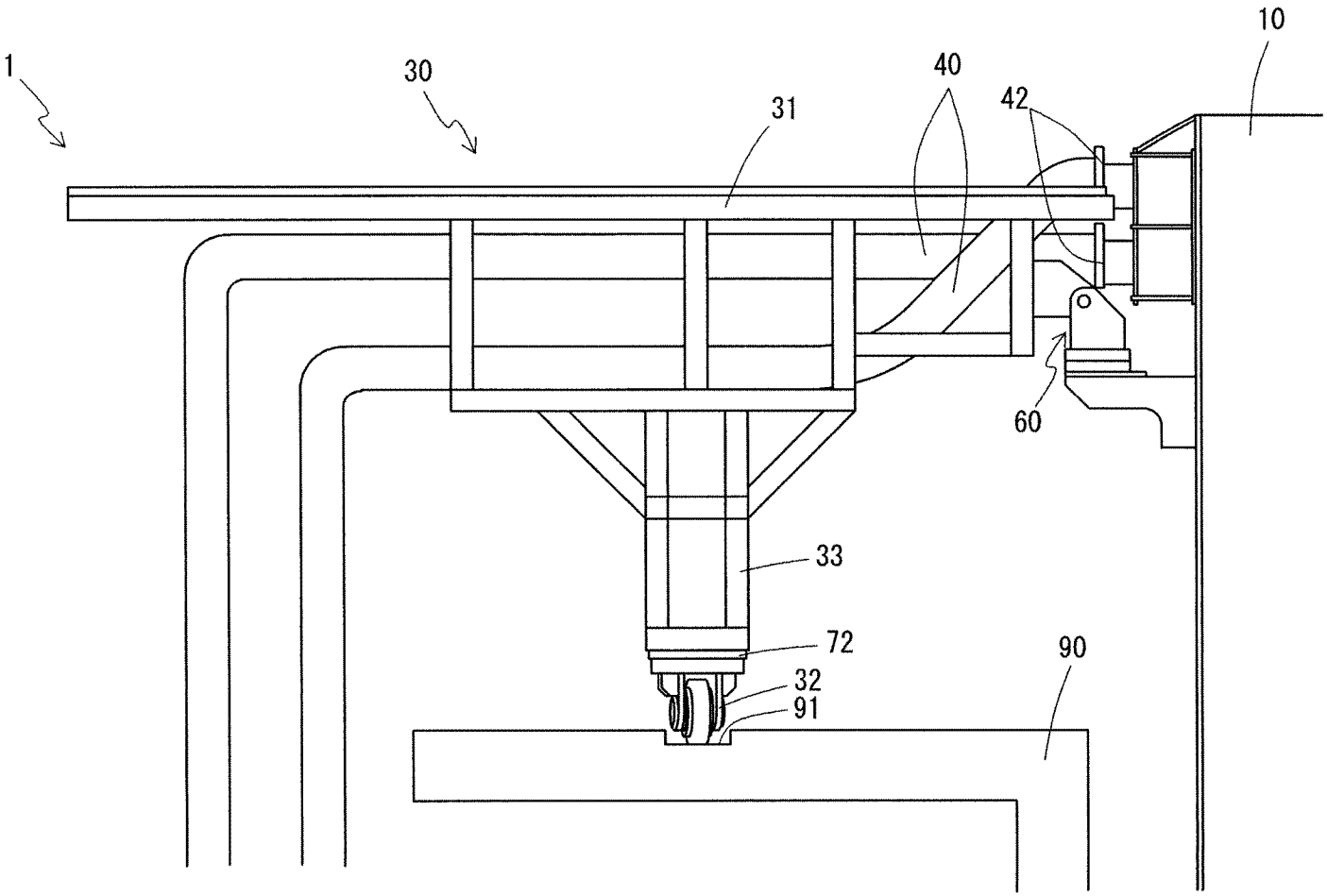
FIG. 3 is a side view illustrating a stand of the electric arc furnace of FIG. 1.

FIG. 1 to FIG. 3 illustrate an electric arc furnace 1 according an embodiment of the present invention. The electric arc furnace 1 is installed on a platform (installation surface) 90. The platform 90 is supported by supporting bases 95 fixed on a floor surface F. The electric arc furnace 1 has a configuration, as a main body part, similar to that of the electric arc furnace (arc furnace) described in Patent Literature 1, and includes a furnace shell 10, a furnace roof 20 and electrodes 25. Further, a stand 30 is installed on the common platform 90 where the electric arc furnace 1 is installed. The electric arc furnace 1 further includes pipes 40 and a furnace shell moving mechanism 50.

The furnace shell 10 is formed as a circular cylindrical bottomed vessel having an opening at its top part. The furnace roof 20 is a member capable of closing the opening of the furnace shell 10 by being driven by a furnace roof moving mechanism (not illustrated). Specifically, the furnace roof 20 performs an up/down movement and a rotation movement above the furnace shell 10, thereby moving between a state of closing the opening of the furnace shell 10 and a state of opening the opening. Furthermore, three electrodes 25 penetrate the furnace roof 20 without contacting the furnace shell 10 and the furnace roof 20, and reach a space inside the furnace shell 10. The three electrodes 25 are arranged to form vertexes of an almost equilateral triangle around a center axis of the furnace shell 10. When a metal material such as iron scrap material is contained in the furnace shell 10 and the three electrodes 25 are supplied with current such as three-phase alternate current to perform discharge, the metal material can be molten. The electric arc furnace 1 is configured as an electric arc furnace of an eccentric bottom tapping (EBT) type, and thus, the electric arc furnace 1 is provided with a tapping hole 11 for tapping molten steel and a slag door 12 for discharging slag as molten residue, at respective opposed positions of side wall of the furnace shell 10 (omitted in FIG. 2).

Figure 5:
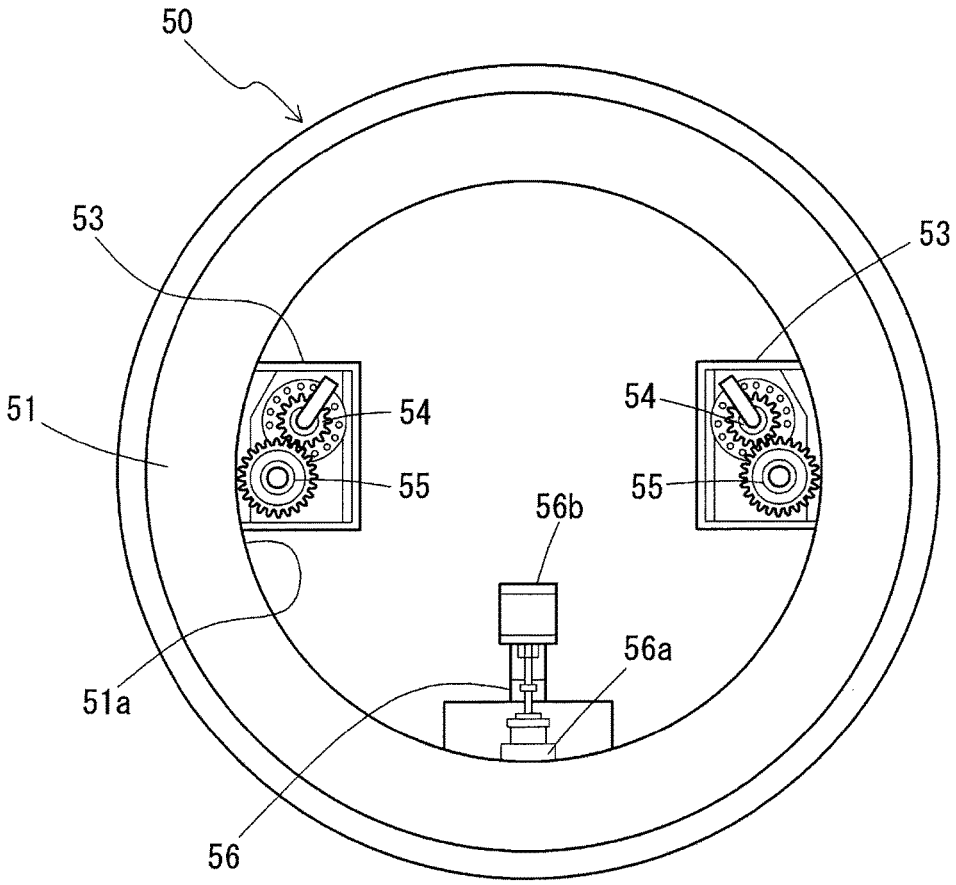
FIG. 5 is a top view schematically illustrating a support frame in a furnace shell moving mechanism of the electric arc furnace of FIG. 1.

The furnace shell 10 is supported by the platform 90 via the furnace shell moving mechanism 50. As the furnace shell moving mechanism 50, use can be made of one similar to that disclosed in Patent Literature 2. The configuration of the furnace shell moving mechanism 50 will be explained briefly. An annular support frame 51, which is provided with a gear member formed along an inner periphery 51 a thereof as illustrated in FIG. 5, is supported by a bearing member 52. The furnace shell 10 is fixed to the support frame 51.

Gear boxes 53 and 53 are provided at two opposed portions of the inside of the support frame 51. Two gears, a first gear 54 and a second gear 55, are housed within each of the gear boxes 53. The first gear 54 is rotatable within a plane parallel to a plane of the platform 90, and the rotation shaft thereof is connected to a motor. The second gears 55 is also arranged to be rotatable within a plane parallel to the plane of the platform 90, and the second gear meshes with the corresponding first gear 54 and also meshes with the gear member provided at the inner periphery 51*a* of the support frame 51. When the first gear 54 is rotated by the motor, the support frame 51 is made to rotate around a center axis thereof via the second gear 55. Thus, the furnace shell 10 fixed on the support frame 51 rotates (circles) around a center axis thereof extending up-down direction. At the time when the furnace shell 10 rotates, respective positions of the electrodes 25 along the plane of the platform 90 do not change. Thus, relative arrangement between the furnace shell 10 and the electrodes 25 changes according to the rotation of the furnace shell 10.

Further, inside of the support frame 51, a lock mechanism 56 is provided at an intermediate between the positions where gear boxes 53, 53 are arranged along the inner periphery of the support frame 51. The lock mechanism 56 includes a plug member 56*a* provided so as to face to the inner periphery 51*a* of the support frame 51 and a driving cylinder 56*b* which can move the plug member 56*a* inward and outward along a radial direction of the support frame 51. The support frame 51 is provided with a sheath member (not illustrated). In a state where a rotation position of the furnace shell 10, that is, a rotation position of the support frame 51, is at an original position, the plug member 56*a* of the lock mechanism 56 can enter into and be held by the sheath member. The original position of the support frame 51 means a rotation position of the furnace shell at which the furnace shell 10 can be tilted together with the platform 90 by using a tilting mechanisms 80 described later and both the tapping of molten metal from the tapping hole 11 and the discharging of slag from the slag door 12 can be performed. During the support frame 51 rotates the furnace shell 10, the plug member 56*a* of the lock mechanism 56 is retracted inward from the support frame 51 so as not to interfere the rotation of the support frame 51. In contrast, during the support frame 51 is stopped at the original position, the driving cylinder 56*b* moves the plug member 56*a* outward to the support frame 51 side, to thereby make the plug member 56*a* enter into and be held by the sheath member provided at the support frame 51. As a result, the rotation of the support frame 51 can be inhibited.

As illustrated in FIG. 1 to FIG. 3, the furnace shell 10 is provided with various kinds of pipes 40 (two in the drawings). In the pipe 40, a fixed end 41 as one end thereof is fixed to the platform 90, or to an equipment which is fixed to a floor F where the platform 90 is installed, such as a wall of a building. In the drawings, each of the pipes 40 is fixed at its fixed end 41 to the wall of the building. A movable end 42 as the other end of each of the pipes 40 is fixed to the furnace shell 10. Each of the pipes 40 is at least partially formed of a flexible material like a flexible hose or the like and allows various fluids such as water, gas or air to pass through a hollow part thereinside. The flexible portion of each of the pipes 40 has a sufficient length so that the pipes 40 can follow the rotation of the furnace shell 10 induced by the furnace shell moving mechanism 50, in a state of being supported by the stand 30 as described below. This kind of pipes 40 are used for supplying fluid to various kinds of auxiliary facilities attached to the furnace shell 10, and examples thereof include pipes used for flowing water in order to circulate the water within a water-cooled panel for cooling the furnace shell 10, or pipes used for supplying fuel gas to a burner for assisting melting of the metal material within the furnace shell 10.

The platform 90 is provided with the stand 30 in adjacent to the furnace shell 10. The stand 30 includes a supporting part 31 and a wheel 32 acting as a stand moving part. The stand 30 has a frame structure in which a plurality of long metal members are arranged crosswise so as to extend in a direction substantially parallel to and in a direction substantially orthogonal to the plane of the platform 90. The supporting part 31 is connected to the wheel 32 via a wheel connecting part 33. The wheel connecting part 33 and the wheel 32 are provided in the vicinity of a center of the supporting part 31 along a direction connecting the stand 30 and the furnace shell 10. A halfway portion of each of the pipes 40 is placed on the supporting part 31 in such a way that the each pipe is passed over the crossed metal members. In order to avoid vibration of the stand 30 being transmitted to the pipes 40, the pipes 40 are not fixed to the stand 30 but merely placed on the metal members constituting the supporting part 31. When the wheel 32 rotates, the stand 30 can move in a state of supporting the halfway portions of the pipes 40 by the supporting part 31. In the present embodiment, the stand 30 is arranged at an almost center position between the tapping hole 11 and the slag door 12 along an outer periphery of the furnace shell 10 so as not to interfere the tapping of molten metal and the discharging of slag.

Figure 4:
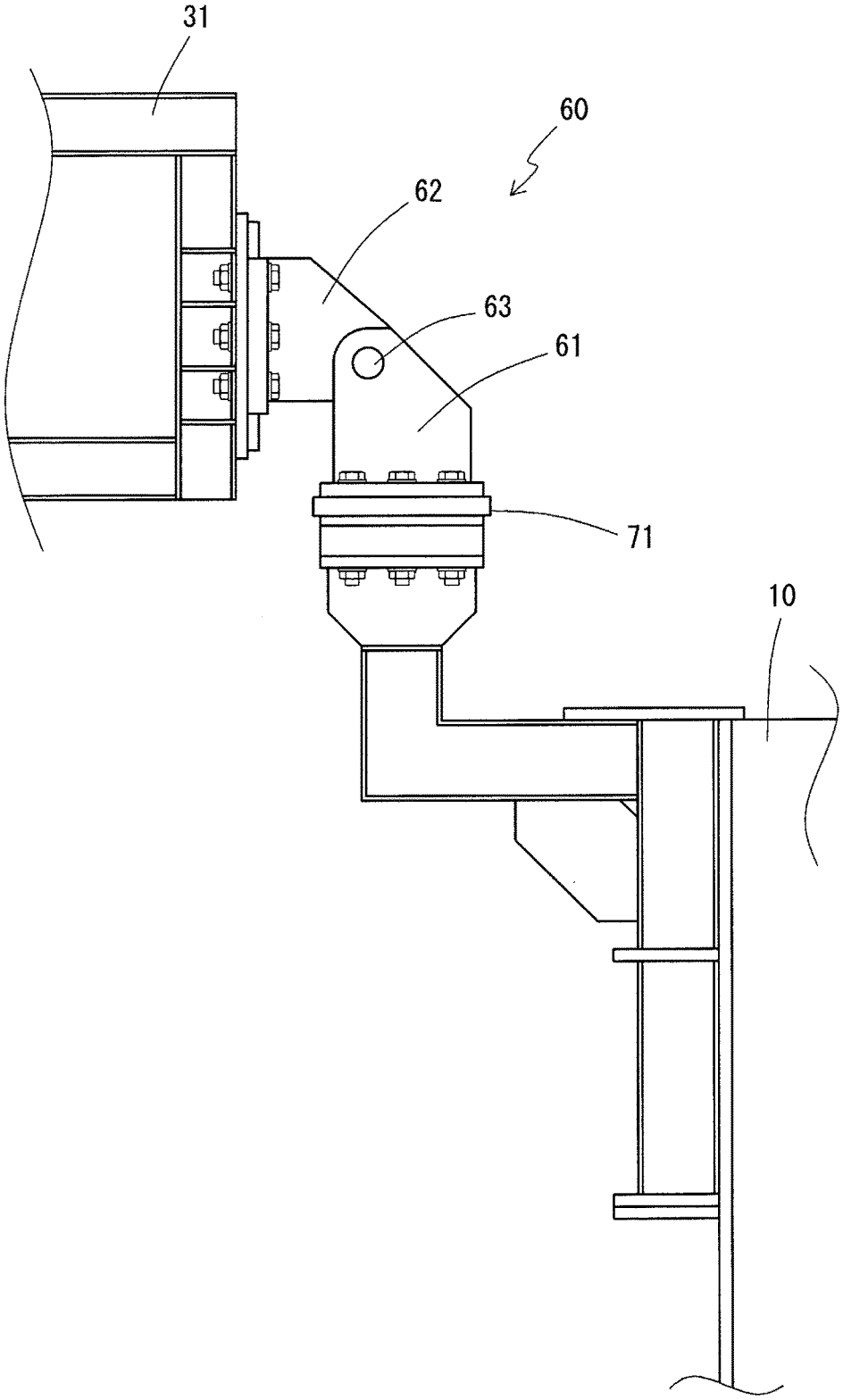
FIG. 4 is a side view illustrating a coupling unit between the stand and the furnace shell of the electric arc furnace of FIG. 1.

A coupling unit 60 for coupling the stand 30 to the furnace shell 10 is provided between the stand 30 and the furnace shell 10. The coupling unit 60 couples the stand 30 to the furnace shell 10 by a pin structure. Specifically, as illustrated in FIG. 4, the coupling unit 60 includes a furnace shell side-coupling member 61 fixed to the furnace shell 10, a stand side-coupling member 62 fixed to the stand 30, and a coupling shaft 63 coupling between the furnace shell side-coupling member 61 and the stand side-coupling member 62. The furnace shell side-coupling member 61 and the stand side-coupling member 62 are each constituted mainly by a substantially flat plate part, and are fixed to the furnace shell 10 and the stand 30, respectively, by screw connection in a state of standing the flat plate parts substantially vertically. The furnace shell side-coupling member 61 is provided so as to protrude upward from an outer side of an outer wall of the furnace shell 10. The stand side-coupling member 62 is provided so as to protrude toward the furnace shell 10 side from an end portion of the supporting part 31 of the stand 30 facing to the furnace shell 10. That is, the furnace shell side-coupling member 61 and the stand side-coupling member 62 protrude substantially orthogonally to each other. The flat plate parts of the furnace shell side-coupling member 61 and the stand side-coupling member 62 are overlapped with each other substantially in parallel at respective portions near their tips. The respective overlapped portions of the flat plate parts are provided with through holes (not illustrated) in an overlapped manner. The rod-shaped coupling shaft 63 is unremovably inserted so as to penetrate both of the through hole provided in the furnace shell side-coupling member 61 and the through hole provided in the stand side-coupling member 62. The coupling shaft 63 is not fixed to at least one of the furnace shell side-coupling member 61 and the stand side-coupling member 62, thereby being rotatable around the axis thereof. In other words, the stand 30 including the stand side-coupling member 62 is arranged in a state of being coupled with the furnace shell 10 including the furnace shell side-coupling member 61 via the coupling shaft 63 so as to be rotatable within a vertical plane. Thus, the stand 30 is movable up and down with respect to the furnace shell 10.

As illustrated in FIG. 1 to FIG. 3, the platform 90 is provided with a groove-shaped rail (track) 91 along which the wheel 32 can move without running off, and the wheel 32 contacts the platform 90 within the rail 91. Since the stand 30 is coupled to the furnace shell 10 via the coupling unit 60 as described above, when the furnace shell 10 is rotated by the furnace shell moving mechanism 50, a force is applied to the stand 30 in a circumferential direction of the furnace shell 10 via the coupling unit 60, and the stand 30 moves in synchronous with the rotation of the furnace shell 10 so as to follow the movement of the furnace shell 10. The rail 91 is formed substantially in an arc-shape at a position corresponding to a locus along which the wheel 32 is to pass when the furnace shell 10 moves in this manner.

A tilting mechanism 80 may be provided at the platform 90 on which the furnace shell 10 and the stand 30 are installed. The tilting mechanism 80 tilts the furnace shell 10 and the stand 30 in a predetermined direction so as to facilitate the tapping and the discharging of slag from the furnace shell 10. In this case, although a relative arrangement between the fixed ends 41 of the pipes 40 and the platform 90 changes in accordance with the tilt movement of the platform 90, this change can be absorbed by the flexibility of the pipes 40.

Figure 6A:
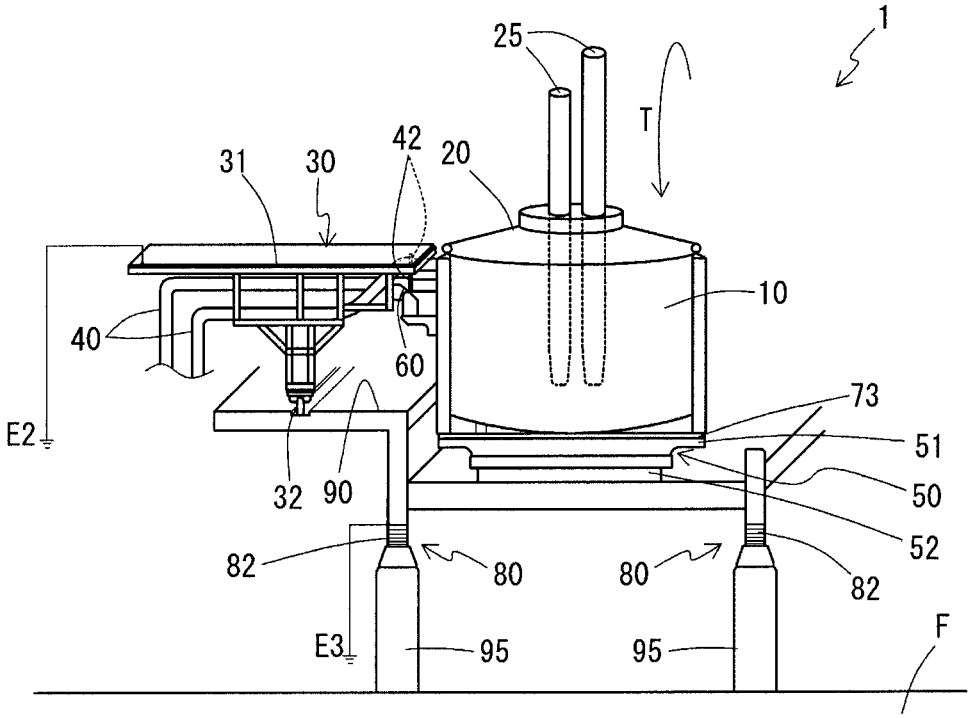
FIGS. 6A and 6B are diagrams illustrating a state where the electric arc furnace of FIG. 1 is tilted on a slag discharging side.
Figure 6B:
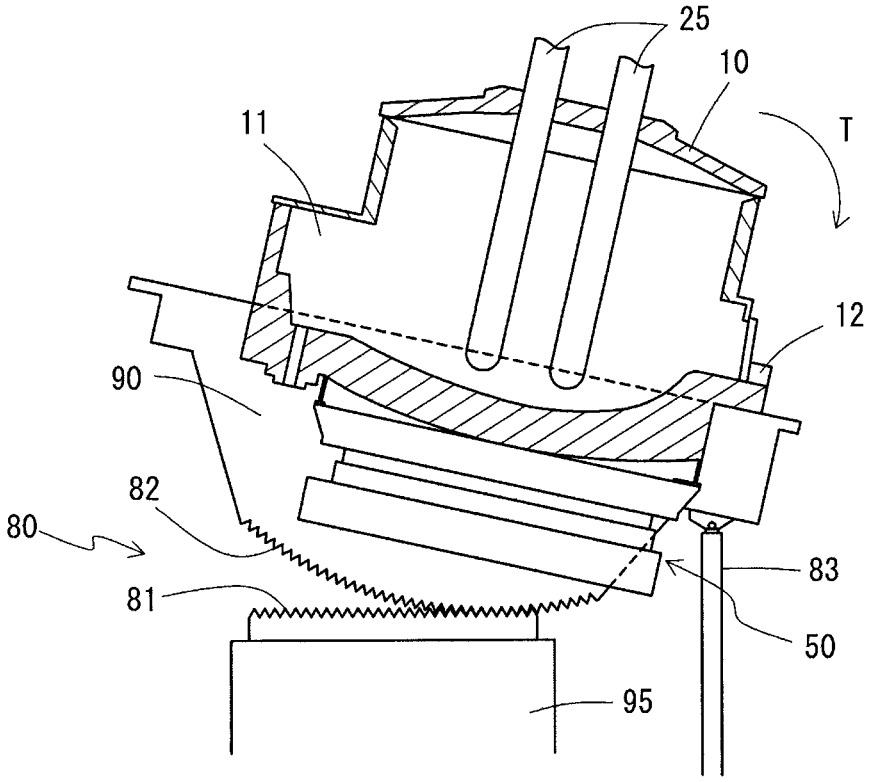

As a concrete configuration of the tilting mechanism 80, use can be made of one similar to that disclosed in Patent Literature 2. The configuration will be explained briefly herein. As illustrated in FIG. 2, FIG. 6A and FIG. 6B, the tilting mechanism 80 includes a gear (supporting base-side gear) 81 provided at the supporting base 95 and a gear (platform-side gear) 82 which meshes with the gear 81 of the supporting base 95 side. The gear 82 is provided at a bottom part of the platform 90 which is formed to have a convex curved surface along a direction connecting the tapping hole 11 and the slag door 12 in the original position. A cylinder 83 is rotatably connected to the platform 90 at an outside position of one end of the gear 82. When a force is applied in an upward or downward direction to one end of the platform 90 by the cylinder 83, the platform 90 is made to roll on the supporting base 95 while maintaining the meshed state between the supporting base-side gear 81 and the platform-side gear 82. Thus, the platform 90 can be tilted in the direction connecting the tapping hole 11 and the slag door 12 in the original position while keeping the furnace shell 10 and the stand 30 vertically supported on the plane of the platform 90. The tapping of molten metal from the tapping hole 11 and the discharging of slag from the slag door 12 can be assisted by this tilting movement. FIG. 6A and FIG. 6B illustrate a state where the downward force is applied to the slag door 12-side portion of the platform 90 by the cylinder 83 and thus the platform 90 is tilted to a direction (direction T) lowering the position of the slag door 12. In this state, the discharging of slag from the slag door 12 is assisted. During the platform 90 is tilted by the tilting mechanisms 80, the rotation of the furnace shell 10 on the platform 90 by the furnace shell moving mechanism 50 is inhibited by the lock mechanism 56.

Further, insulating members are provided at respective portions of the present electric arc furnace 1. Specifically, a coupling unit insulation plate 71 (FIG. 4) is provided between the furnace shell side-coupling member 61 and the furnace shell 10. A wheel part insulation plate 72 (FIG. 3) is provided between the wheel connecting part 33 of the stand 30 and the wheel 32. Further, a furnace shell part insulation plate 73 (FIG. 2) is provided between a bottom portion of the furnace shell 10 and the support frame 51 of the furnace shell moving mechanism 50. Each of these insulation plates 71 to 73 electrically insulates between members disposed at both sides thereof. Further, the furnace shell 10, the stand 30 and the bearing member 52 of the furnace shell moving mechanism 50 are independently grounded by ground connection ports E1 to E3, respectively.

(Characteristics of Electric Arc Furnace)

As described above, in the electric arc furnace 1 according to the present embodiment, a positional relation between the furnace shell 10 and the electrodes 25 can be changed by rotating the furnace shell 10 with respect to the electrodes 25. By changing the positional relation, uniformity of heating and melting of the metal material within the furnace shell 10 can be enhanced. That is, as the electrodes 25 arranged to form an almost equilateral-triangle shape at the center of the furnace shell 10 having an almost circular cylindrical shape are inserted, a hot spot, which is close to the electrodes 25 and likely to be a high temperature, and a cold spot, which is distant from the electrodes 25 and unlikely to be a high temperature, are inevitably generated within the furnace shell 10. However, by rotating the furnace shell 10 to change the positional relation between the furnace shell 10 and the electrodes 25 during the melting process of the metal material, respective positions of the hot spot and the cold spot in the furnace shell 10 can be also changed, whereby the uniformity of heating and melting of the metal material can be attained. In terms of necessarily and sufficiently changing the respective positions of the hot spot and the cold spot, a rotatable angle of the furnace shell 10 is preferably in a range of substantially from 50° to 60° in the case where the number of electrodes is three.

When the furnace shell 10 rotates in this manner, the movable ends 42 of the pipes 40 move together with the furnace shell 10 in a state where the fixed ends 41 are kept to be fixed to the platform 90. Since the pipe 40 has the at least partially flexible portion, the pipe 40 can change and deform so as to follow the movement of the furnace shell 10. However, if the portion between the fixed end 41 and the movable end 42 of the pipe 40 is not supported by the stand 30, the pipe 40 is applied with a large load due to its own weight. Further, a force such as a tension may be applied to the pipe 40 even due to the movement of the furnace shell 10, and hence an excessive load may be applied to the pipe. Such the loads may cause various kinds of damages such as breakage of the material constituting the pipe 40 or looseness of coupling structure of the pipe such as a joint of the fixed end 41 or the movable end 42. These damages may result in a situation such as leakage of the fluid flowing within the pipe 40. However, in the electric arc furnace 1, the halfway portion of each of the pipes 40 is supported by the stand 30, and further the stand 30 moves in synchronous with the rotation of the furnace shell 10. Thus, an excessive load due to the change and deformation is unlikely to be applied to each of the pipes 40 even when the furnace shell 10 rotates. In this manner, the pipes 40 and the coupling structure thereof are suppressed from being damaged with the rotation of the furnace shell 10.

The stand 30 moves so as to follow the rotation of the furnace shell 10 in a manner that the wheel 32 rotates and moves along the rail 91 provided on the platform 90. If the platform 90 or the rail 91 has an irregularity, the irregularity is transmitted to the stand 30 as an up/down vibration. If the stand 30 vibrates up and down, this vibration may be transmitted to the pipes 40. The vibration of the stand 30 may also cause damages at respective portions of the pipes 40 such as the breakage of the material constituting the pipes 40 or the looseness of coupling structure of the pipes such as joints, which may result in the situation such as leakage of the fluid flowing within the pipes 40. However, in the electric arc furnace 1 according to the present embodiment, the furnace shell 10 and the stand 30 are connected so as to be movable up and down by the coupling unit 60 having the pin structure. Thus, even when the stand 30 vibrates up and down due to the irregularity on the rail 91, this vibration is absorbed by up/down movement of the coupling unit 60. As a result, the vibration of the stand 30 can be avoided being transmitted to the pies 40 via the fixed ends 41. The stand 30 can be used for supporting not only the pipes 40 for flowing the fluid but also halfway portions of various members each having at least partially flexible portion and being fixed at its one end to the electric arc furnace 1, such as electric wirings for driving and controlling various auxiliary facilities attached to the furnace shell 10.

A range within which the coupling unit 60 is movable up and down only has to be substantially the same as or more than a height difference of the irregularity on the rail 91. In terms of typical irregularity of the platform capable of supporting this kind of the electric arc furnace 1, the movable range of the coupling unit 60 may be in a range of from 1 mm to 50 mm. In the case of using the pin structure described above, if the movable range is converted into a rotation angle around the coupling shaft 63, the rotation angle may be substantially in a range of from 1° to 10° assuming that the furnace shell 10 has a diameter of almost from several meters to 10 meters.

Concrete structure of the coupling unit 60 may be any type so long as the coupling unit can couple the stand 30 to the furnace shell 10 so as to be movable up and down and can transmit a movement of the furnace shell 10 within the plane of the platform 90 to the wheel 32 as the stand moving part, thereby moving the stand 30 so as to follow the furnace shell 10. In the case where the coupling unit 60 contains the pin structure as described above, the stand 30 can be moved on the platform 90 so as to follow the rotation of the furnace shell 10 while securing the up/down movement of the stand 30, with a simple configuration. As other coupling structures than the pin structure, which is capable of moving the stand 30 on the plane of the platform 90 so as to follow the movement of the furnace shell 10 while making the stand 30 movable up and down, there may be mentioned a structure which can couple the stand 30 to the furnace shell 10 via a member that is expandable up and down, such as a bellows, a spring or an elastic member.

In the case where the stand 30 is configured to be movable on the platform 90 by the wheel 32, the stand 30 can be moved so as to automatically follow the movement of the furnace shell 10 with a simple configuration. Further, when the rail 91, along which the wheel 32 moves, is provided on the platform 90, the movement of the stand 30 following the furnace shell 10 can be guided smoothly. However, the stand moving part is not necessarily limited to the wheel 32, and may be a structure using a roller or a bearing, for example. In addition, in the case where the stand 30 is configured to automatically follow the rotation of the furnace shell 10 via the coupling structure provided between the furnace shell 10 and the stand 30, such as the coupling unit 60 as in the above-described embodiment, the movement of the stand 30 can be easily synchronized with the movement of the furnace shell 10 without driving the movement of the stand 30 by any active mechanism. However, the stand 30 may be made to be moved by an independent active mechanism without coupling the stand 30 to the furnace shell 10 while ensuring the synchronization therebetween.

In the electric arc furnace 1 according to the present embodiment, the wheel 32 as the stand moving part is arranged to place near the center of the supporting part 31. In the case where the stand moving part is provided at a halfway portion of the supporting part 31, that is, at a position of the supporting part along the direction connecting the stand 30 and the furnace shell 10 except for both ends, the pipes 40 can be supported by the stand 30 in a well-balanced state. And thus, each of the pipes 40 can be effectively protected from a load due to the own weight of the each pipe 40, the movement of the stand 30 and vibration accompanied by this movement. The stand moving part is preferably provided at a portion of the supporting part almost in a range from ⅓ to ⅔ of the entire length of the supporting part 31 from the furnace shell 10 side, along the direction connecting the stand 30 and the furnace shell 10. Although the only one wheel 32 is provided at the stand 30, from a viewpoint of stability and security of support and movement of the stand 30, two or more wheels may be provided at positions passing on the same rail 91.

The tilting mechanisms 80 are not necessarily provided in the electric arc furnace 1. However, in an electric arc furnace of a type for tapping molten metal from a position deviated from the center of the furnace shell, such as the EBT type furnace, usually some kind of a tilting mechanism is provided. In the case where the fixed end 41 of the pipe 40 is fixed to a facility which is fixed with respect to the floor F, such as a wall of a building, if the pipe 40 is not supported by the stand 30, a rotation torque due to weight of the pipe 40 is directly applied to the furnace shell 10 via the movable end 42 at the time when the furnace shell 10 is tilted. Thus, the tilting of the platform 90 may also cause damage of the furnace shell 10 or looseness of the coupling structure of the pipe or the like, like the rotation of the furnace shell 10. However, as described above, in the case where the pipe 40 is supported by the stand 30 which tilts together with the furnace shell 10, the rotation torque applied from the pipe 40 can be received by the stand 30, thereby reducing a load applied to the furnace shell 10 and the coupling structure of the pipe. In the present embodiment, the stand 30 is provided at the almost center position between the tapping hole 11 and the slag door 12 along an outer periphery of the furnace shell 10 so that the stand 30 does not interfere the tapping of molten metal and the discharging of slag. Thus, the tilting direction of the platform 90 at the original position is substantially orthogonal to an arrangement direction of the stand 30 with respect to the furnace shell 10. This directional relation also contributes to reduction of the rotation torque applied to the furnace shell 10 at the time of tilting the furnace shell 10.

As a method of reducing influence of a load applied to the furnace shell 10 from the pipes 40 accompanied with the rotation of the furnace shell 10 on the platform 90 and the tilting of the platform 90, it is considered to design the furnace shell 10 firmly in place of providing the stand 30. However, because a total weight of both the pipes 40 and contents thereof sometimes exceeds 10 tons, in order to sufficiently reduce the influence of such the heavy members, it is necessary to extremely enlarge or increase a weight of the furnace shell 10. In contrast, in the case where the stand 30 is provided so as to support the pipe 40 as described above, a load applied to the furnace shell 10 can be reduced without designing the furnace shell 10 excessively firmly.

As described above, when the platform 90 is tilted by the tilting mechanisms 80, the rotation of the support frame 51 in the furnace shell moving mechanism 50 is inhibited by the lock mechanism 56. Therefore, rotation of the furnace shell 10 on the platform 90 is inhibited and further, movement of the stand 30 on the platform 90 is inhibited via the coupling unit 60. As a result, the furnace shell 10 and the stand 30 are stably kept in a state of being supported by the platform 90 during the platform 90 is being tilted. Since the furnace shell 10 and the stand 30 are coupled by the coupling unit 60, if a lock mechanism capable of inhibiting the movement on the platform 90 is provided in at least one of the furnace shell moving mechanism 50 and the stand 30, both movement of the furnace shell 10 and the stand 30 can be inhibited. However, as described above, in the case of employing the lock mechanism 56, which acts on the support frame 51 itself serving as a driving source of the movement of the furnace shell 10 and the stand 30, to thereby inhibit the rotation of the support frame 51, both the movement of the furnace shell 10 and the stand 30 can be effectively inhibited. In a case where the movement of the stand 30 cannot be inhibited sufficiently only by the lock mechanism 56 provided at the furnace shell moving mechanism 50, such as a case where a weight of the stand 30 is large, a lock mechanism, for example, for inhibiting the rotation of the wheel 32 may be provided on the stand 30 in addition to the lock mechanism 56 of the furnace shell moving mechanism 50.

In the electric arc furnace 1 according to the present embodiment, since the coupling unit insulation plate 71 is provided between the furnace shell side-coupling member 61 of the coupling unit 60 and the furnace shell 10, the furnace shell 10 and the stand 30 are electrically insulated to each other. Further, since the wheel part insulation plate 72 is provided between the wheel connecting part 33 of the stand 30 and the wheel 32, the supporting part 31 of the stand 30 and the wheel 32 are electrically insulated to each other. The furnace shell 10 and the stand 30 are independently grounded. Since alternate current of 10 kA order may flow to the electrodes 25 inserted into the furnace shell 10, an induction current in a range of from several amperes to several hundred amperes may also flow in the surface of the furnace shell 10 made of metal. If such the large current flows to the wheel 32 via the coupling unit 60 and the supporting part 31 of the stand 30, a spark may be generated at the wheel 32, and smooth movement of the wheel 32 may be interfered or the wheel 32 may be irreversibly damaged. If this situation occurs at the wheel 32, the up/down vibration of the stand 30 becomes large and such the vibration may not be absorbed sufficiently by the up/down movement of the coupling unit 60. Then, as described above, this current flowing to the wheel 32 from the furnace shell 10 can be prevented by insulating between the furnace shell 10 and the stand 30 and further insulating between the supporting part 31 of the stand 30 and the wheel 32, and by independently grounding the furnace shell 10 and the stand 30.

In addition, the furnace shell 10 and the furnace shell moving mechanism 50 are electrically insulated by providing the furnace shell part insulation plate 73 therebetween. Further, the furnace shell 10 and the furnace shell moving mechanism 50 are independently grounded. Therefore, the induction current flowing in the furnace shell 10 is prevented from flowing to the furnace shell moving mechanism 50. If current flows to the furnace shell moving mechanism 50, the bearing member 52 may be damaged. In this case, not only smooth rotation of the furnace shell 10 may be interfered but also up/down vibration is likely to be applied to the pipe 40 due to the rotation itself of the furnace shell 10.

(Other Embodiments)

Figure 7:
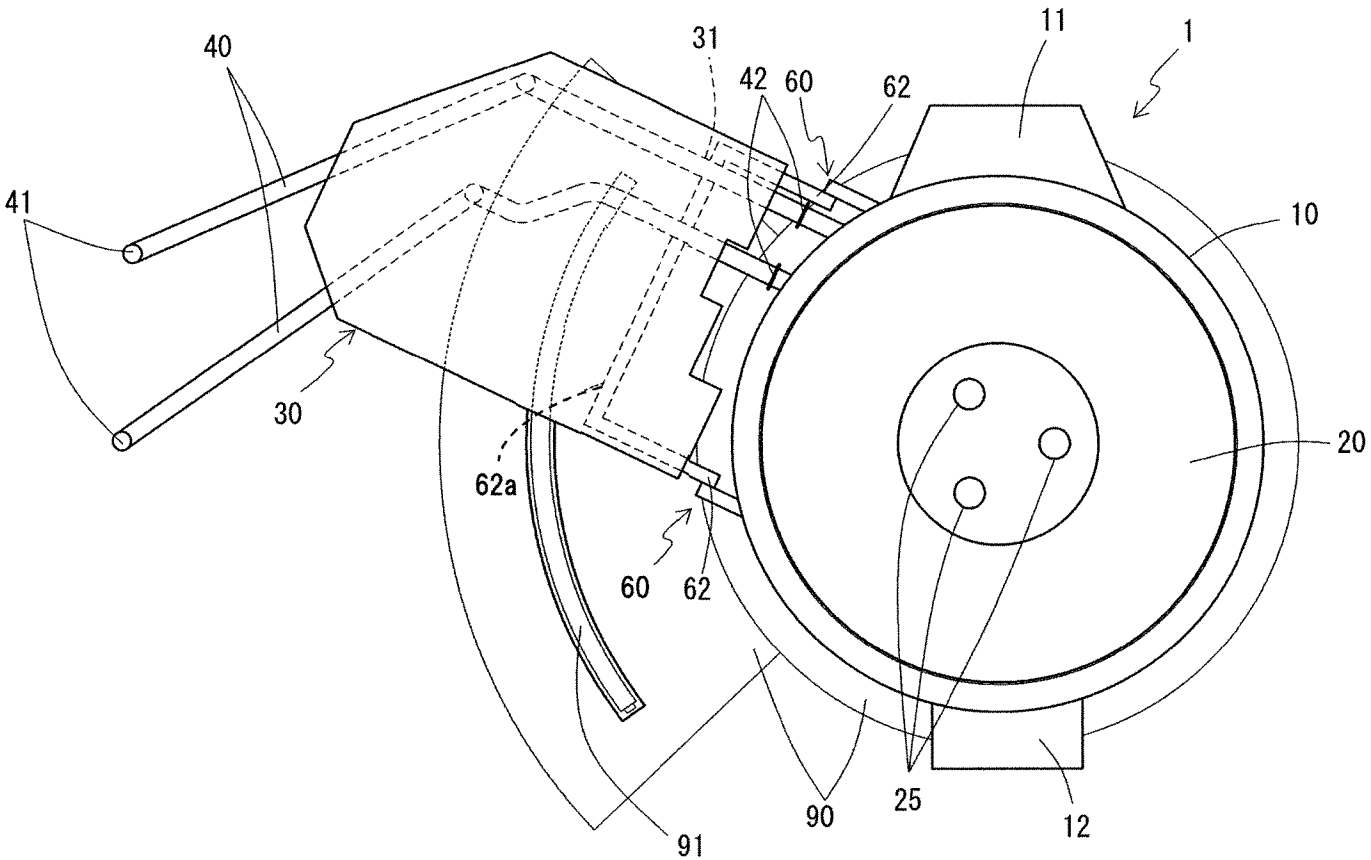
FIG. 7 is a top view illustrating a modified embodiment of the electric arc furnace of FIG. 1.

In the electric arc furnace 1, various modified embodiments other than the above-described embodiment are conceivable. For example, although only the single coupling unit 60 for coupling the furnace shell 10 and the stand 30 is provided in the above-described embodiment, a plurality of coupling units each similar to the coupling unit 60 may be provided in a viewpoint of stabilizing the coupling. For example, as in a modified embodiment illustrated in FIG. 7, two coupling units 60, 60 may be provided at respective positions corresponding to both ends of the stand 30 along a circumferential direction of the furnace shell 10. A coupling beam 62a may couple between stand side-coupling members 62, 62 of the two coupling units 60, 60 as U-shape.

A furnace to which the furnace shell 10 is applied is not limited to the electric arc furnace such as an arc furnace, but may be any principle type so long as it is a melting furnace which can promote uniform melting of metal material by moving a furnace shell. The movement of the furnace shell is not limited to a rotation (revolution) around the center axis thereof but may be any movement on the surface of the platform. Further, the electric arc furnace is not limited to the EBT type furnace but may be another type such as a molten delivery trough type furnace. However, in a case of providing the tilting mechanism as described above, a centric bottom tapping (CBT) type furnace not required to be tilted is removed.

As described above, although the embodiments according to the present invention are explained in detail, the present invention is not limited to the above-described embodiments and may be changed and modified in various manners within a range not departing from the gist of the present invention.

The present application is based on the Japanese patent applications No. 2014-225147 filed on Nov. 5, 2014 and No. 2015-146742 filed on Jul. 24, 2015, which contents are incorporated herein by reference.

DESCRIPTION OF REFERENCE NUMERALS

1 electric arc furnace (melting furnace)
10 furnace shell
20 furnace roof
30 stand
31 supporting part
32 wheel (stand moving part)
33 wheel connecting part
40 pipe
41 fixed end
42 movable end
50 furnace shell moving mechanism
54 first gear
55 second gear
56 lock mechanism
60 coupling unit
61 furnace shell side-coupling member
62 stand side-coupling member
63 coupling shaft
80 tilting mechanism
81 supporting base-side gear
82 platform-side gear
83 cylinder
90 platform (installation surface)
91 rail (track)
95 supporting base

What is claimed is:

1. A melting furnace, comprising:

a furnace shell;

a furnace shell moving mechanism that supports the furnace shell so as to be movable on an installation surface;

a pipe or a wiring that has one end fixed to the furnace shell and has at least partially a flexible portion; and a stand that comprises a supporting part that supports a halfway portion of the pipe or the wiring, and a stand moving part that is coupled to the supporting part, the stand moving part comprising a wheel that moves the supporting part on the installation surface with movement of the furnace shell, wherein the stand is mounted on the installation surface so as to be movable in an up-down direction with respect to the furnace shell, and a coupler comprising a furnace shell side-coupler fixed to the furnace shell, a stand side-coupler fixed to the stand, and a coupling shaft directly connecting the furnace shell side-coupler and the stand side-coupler.

2. The melting furnace according to claim 1, wherein the supporting part is coupled to the furnace shell so as to be movable up and down by the coupler, which transmits movement of the furnace shell induced by the furnace shell moving mechanism to the wheel.

3. The melting furnace according to claim 2, wherein the coupling shaft couples the stand to the furnace shell so as to make the stand rotatable within a plane containing the up-down direction, and so as to make the stand rotatable in a vertical plane with respect to the furnace shell and the furnace shell-side coupler via the coupling shaft.

4. The melting furnace according to claim 2, further comprising a track installed in order to guide the movement of the wheel.

5. The melting furnace according to claim 1, wherein the stand moving part is provided at a halfway portion of the supporting part.

6. The melting furnace according to claim 1, further comprising an insulation installed in at least one of a portion between the supporting part and the furnace shell, a portion between the supporting part and the stand moving part, and a portion between the furnace shell and the furnace shell moving mechanism.

7. The melting furnace according to claim 6, wherein the furnace shell, the furnace shell moving mechanism and the supporting part are independently grounded.

8. The melting furnace according to claim 1, wherein the installation surface is tiltable in a state of supporting the furnace shell and the stand.

9. The melting furnace according to claim 1, further comprising:

a lock mechanism in at least one of the furnace shell moving mechanism and the stand, wherein the lock mechanism inhibits movement of the furnace shell and the stand on the installation surface.

10. The melting furnace according to claim 1, wherein:

the furnace shell moving mechanism comprises an annular support frame having a gear member, a bearing that supports the annular support frame, and a gear provided adjacent to the annular support frame, the furnace shell is fixed on the annular support frame, the gear is rotatable within a plane parallel to a plane of the platform, and the rotation shaft thereof is connected to a motor, and the platform is supported by a supporting base fixed on a floor surface, and the platform is tiltable in a state of supporting the furnace shell and the stand.

11. A melting furnace, comprising:

a furnace shell;

a furnace shell support configured to support the furnace shell so as to be movable on an installation surface;

one of a pipe and a wire having one end fixed to the furnace shell and having at least a partially-flexible section; and a stand comprising:

a stand support configured to support a halfway section of the one of the pipe and the wire; and a wheel coupled to the stand support and configured to move the stand support on the installation surface with movement of the furnace shell, wherein the stand is mounted on the installation surface so as to be movable in an up-down direction with respect to the furnace shell, and a coupler comprising a furnace shell side-coupler fixed to the furnace shell, a stand side-coupler fixed to the stand, and a coupling shaft directly connecting the furnace shell side-coupler and the stand side-coupler.

* * * * *